US008138984B2

(12) United States Patent
Chung et al.

(10) Patent No.: US 8,138,984 B2
(45) Date of Patent: Mar. 20, 2012

(54) PLANAR ANTENNA

(75) Inventors: Shyh-Jong Chung, Guanxi Township (TW); Sy-Been Wang, Zhubei (TW); Ching-Wei Ling, Xinhua Township (TW)

(73) Assignee: National Chiao Tung University, Hsinchu (TW)

( * ) Notice: Subject to any disclaimer, the term of this patent is extended or adjusted under 35 U.S.C. 154(b) by 374 days.

(21) Appl. No.: 12/510,618

(22) Filed: Jul. 28, 2009

(65) Prior Publication Data

US 2010/0188294 A1 Jul. 29, 2010

(30) Foreign Application Priority Data

Jan. 23, 2009 (TW) ..... 98103116 A

(51) Int. Cl.
*H01Q 13/00* (2006.01)

(52) U.S. Cl. ..... 343/767; 343/770

(58) Field of Classification Search ..... 343/767, 343/770, 702

See application file for complete search history.

(56) References Cited

U.S. PATENT DOCUMENTS

| | | | | |
|---|---|---|---|---|
| 7,696,942 | B2 * | 4/2010 | Kim et al. | 343/767 |
| 2005/0088354 | A1 * | 4/2005 | Chang | 343/767 |
| 2009/0079647 | A1 * | 3/2009 | Jung et al. | 343/767 |
| 2009/0128434 | A1 * | 5/2009 | Chang et al. | 343/767 |

OTHER PUBLICATIONS

Chung, et al. Five-Band Planar Antenna for Laptop Applications, Industrial Technology R&D Master Program of Electrical and Computer Engineering College, National Chiao Tung Unversity, Jun. 2008.

* cited by examiner

*Primary Examiner* — Tan Ho

(74) *Attorney, Agent, or Firm* — WPAT, P.C.; Anthony King

(57) ABSTRACT

The present invention discloses a planar antenna including a substrate, a ground plane and a feed line. The ground plane is disposed on one side of the substrate. The ground plane includes a hollow portion. The feed line disposed on another side of the substrate and corresponding to the hollow portion for feeding a signal. The present invention also discloses a planar antenna including a substrate, a ground plane and a feed line. The ground plane is disposed on one side of the substrate. The ground plane includes a first hollow portion and a second hollow portion. The feed line is disposed on another side of the substrate and having a first branch feed portion and a second branch feed portion for feeding a signal, and the first branch feed portion and the second branch feed portion are aligned with the first hollow portion and the second hollow portion respectively.

22 Claims, 23 Drawing Sheets

PLANAR ANTENNA

BACKGROUND OF THE INVENTION

1. Field of the Invention

The present invention relates to a planar antenna, in particular to an embedded multiband/wideband planar antenna having a slender area with a limited width.

2. Description of the Related Art

In an antenna design, a metal sheet is generally used for making a reflector or a ground plane of the antenna. After the metal sheet is disposed and a sufficient distance is kept between the metal sheet and the antenna, the antenna not only increases the antenna gain effectively, but also decreases the backward radiation of the antenna to reduce unnecessary energy losses. However, present communication products tend to become increasingly smaller, and the height of antennas depends on an overall height of a product, and thus a compact and low profile design is required. For example, the antenna of a notebook computer is generally designed and disposed at the top or both sides of a computer screen. As shown in FIG. 1, an available space is a slender area with a limited width, and thus the antenna may be designed on a printed circuit board at a back panel of the computer screen. However, if the metal ground plane and the antenna are very close to one another as shown in FIG. 2, an inverted L-shaped monopole antenna will be used. Since the distance between a horizontal arm of the antenna and the ground plane is too close, an image current produced on the ground plane 2 is in the opposite direction to the current on the antenna and thus will be offset by each other and result in poor antenna gain and radiation efficiency.

SUMMARY OF THE INVENTION

In view of the aforementioned shortcomings of the prior art, the present invention provides a planar antenna to achieve the objective of overcoming the shortcomings.

To achieve the foregoing objectives, the present invention provides a planar antenna comprising a substrate, a ground plane and a feed line, wherein the ground plane is disposed on one side of the substrate, and the ground plane includes a hollow portion, and the feed line is disposed on another side of the substrate and corresponding to the hollow portion for feeding a signal.

Another objective of the present invention is to provide a planar antenna, comprising a substrate, a ground plane and a feed line, wherein the ground plane is disposed on one side of the substrate, and the ground plane includes a first hollow portion and a second hollow portion, and the feed line is disposed on another side of the substrate and having a first branch feed portion and a second branch feed portion, for feeding a signal, and the first branch feed portion and the second branch feed portion are aligned with the first hollow portion and the second hollow portion respectively.

The planar antenna of the present invention has one or more of the following advantages:

(1) The planar antenna comes with a planar design, and thus occupies a smaller volume than a general three-dimensional antenna.

(2) The planar antenna adopts a printed circuit board process to reduce the manufacturing cost of the antenna.

(3) The ground plane of the planar antenna comes with a size of a ground plane of a general notebook computer, a thin notebook computer, a PDA or a mobile phone.

(4) The slot of the planar antenna may be disposed at any position on a lateral edge of the ground plane.

(5) The planar antenna may be a dual-band, wideband, or multiband antenna.

DETAILED DESCRIPTION OF THE PREFERRED EMBODIMENTS

Figure 1:
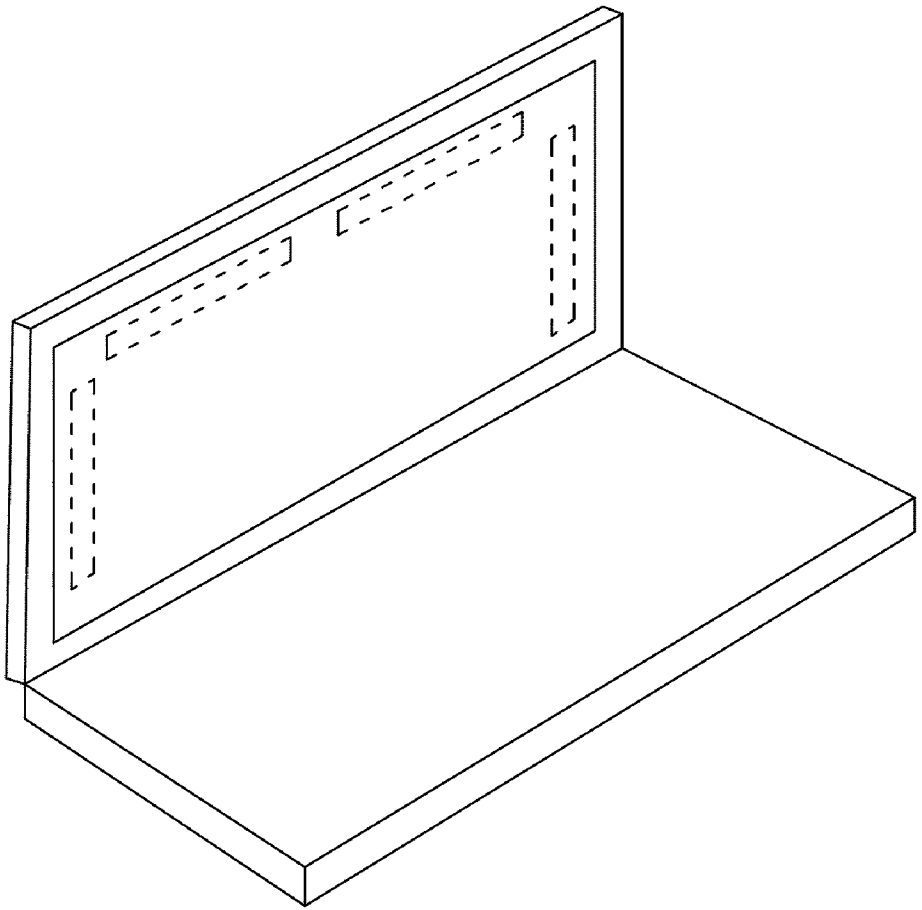
FIG. 1(PRIOR ART)
FIG. 1 is a schematic view of an antenna position designed for a conventional antenna of a notebook computer.
Figure 2:
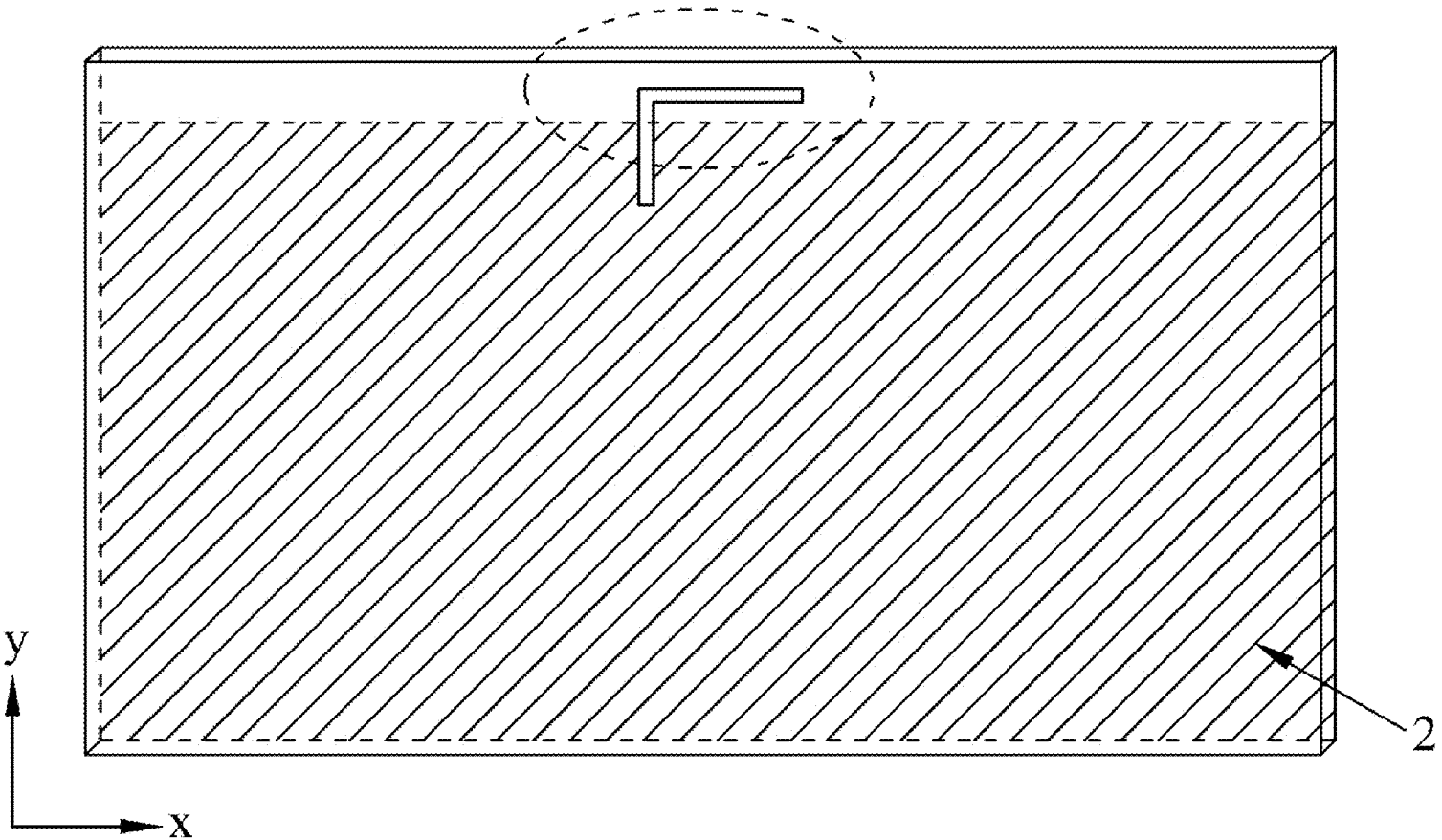
FIG. 2(PRIOR ART)
FIG. 2 is a schematic view of a conventional inverted L-shaped monopole antenna.
Figure 3:
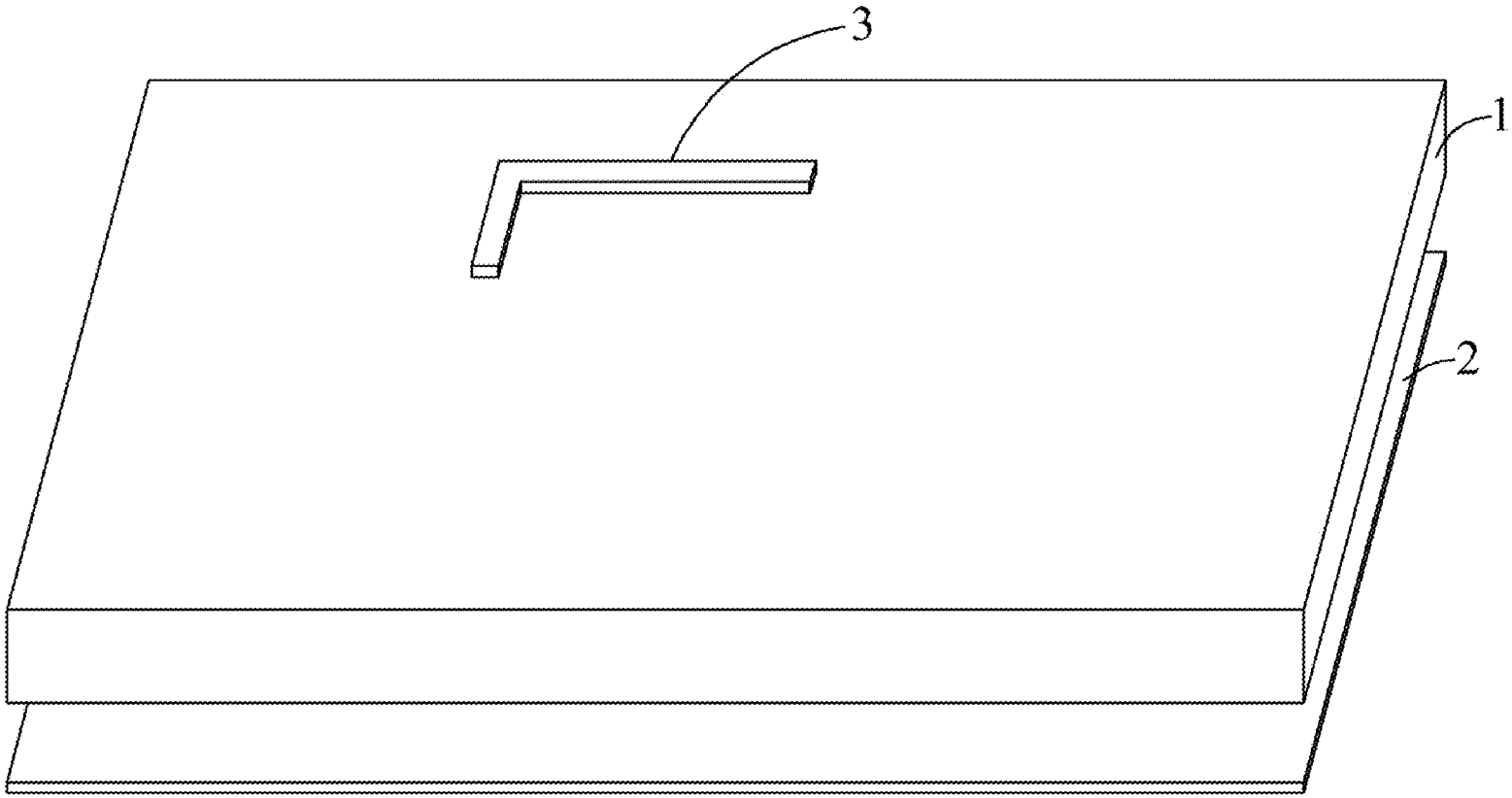
FIG. 3 is an exploded view of a planar antenna in accordance with a first preferred embodiment of the present invention.
Figure 4:
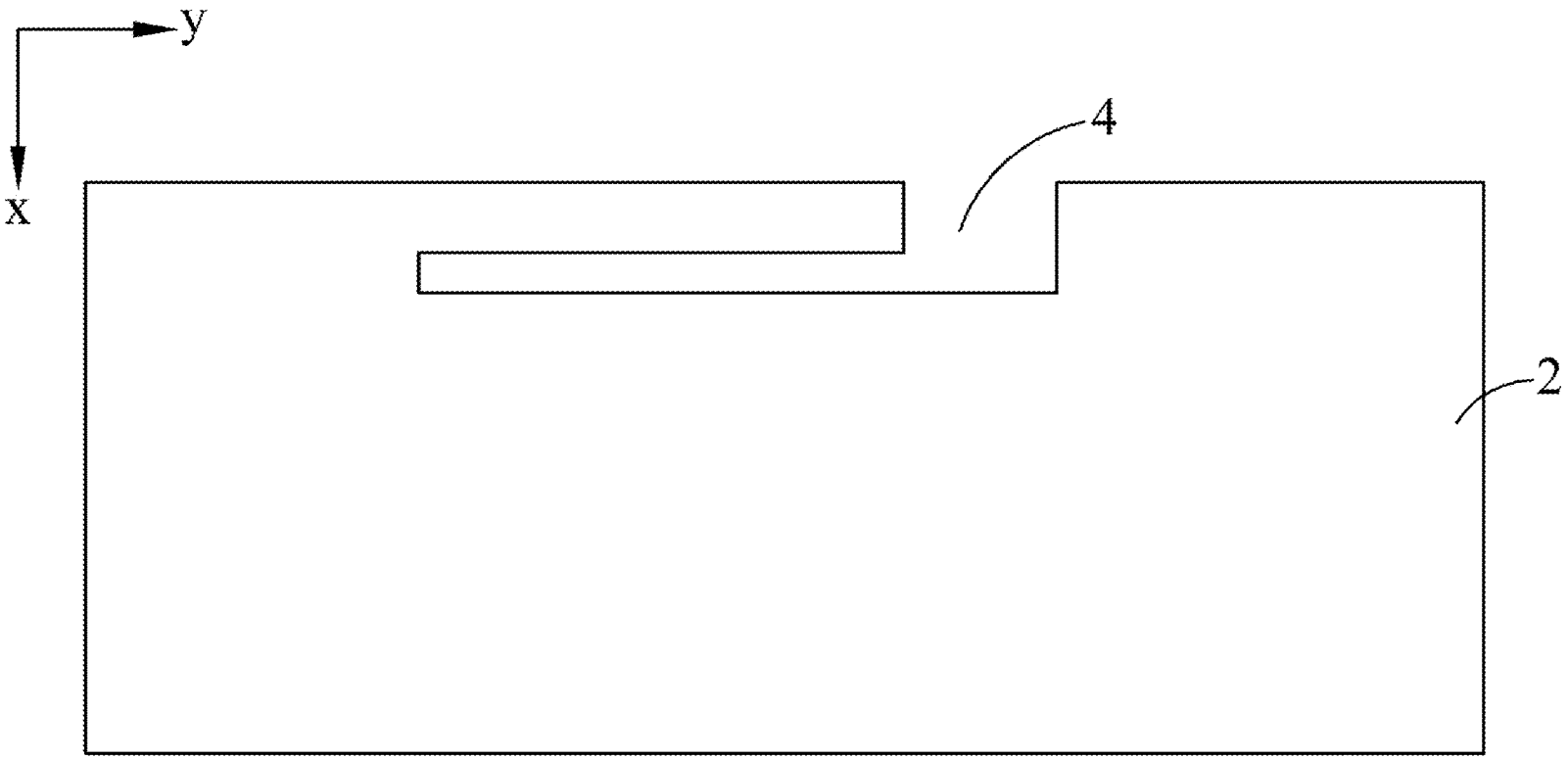
FIG. 4 is a bottom view of a planar antenna in accordance with a first preferred embodiment of the present invention.
Figure 5:
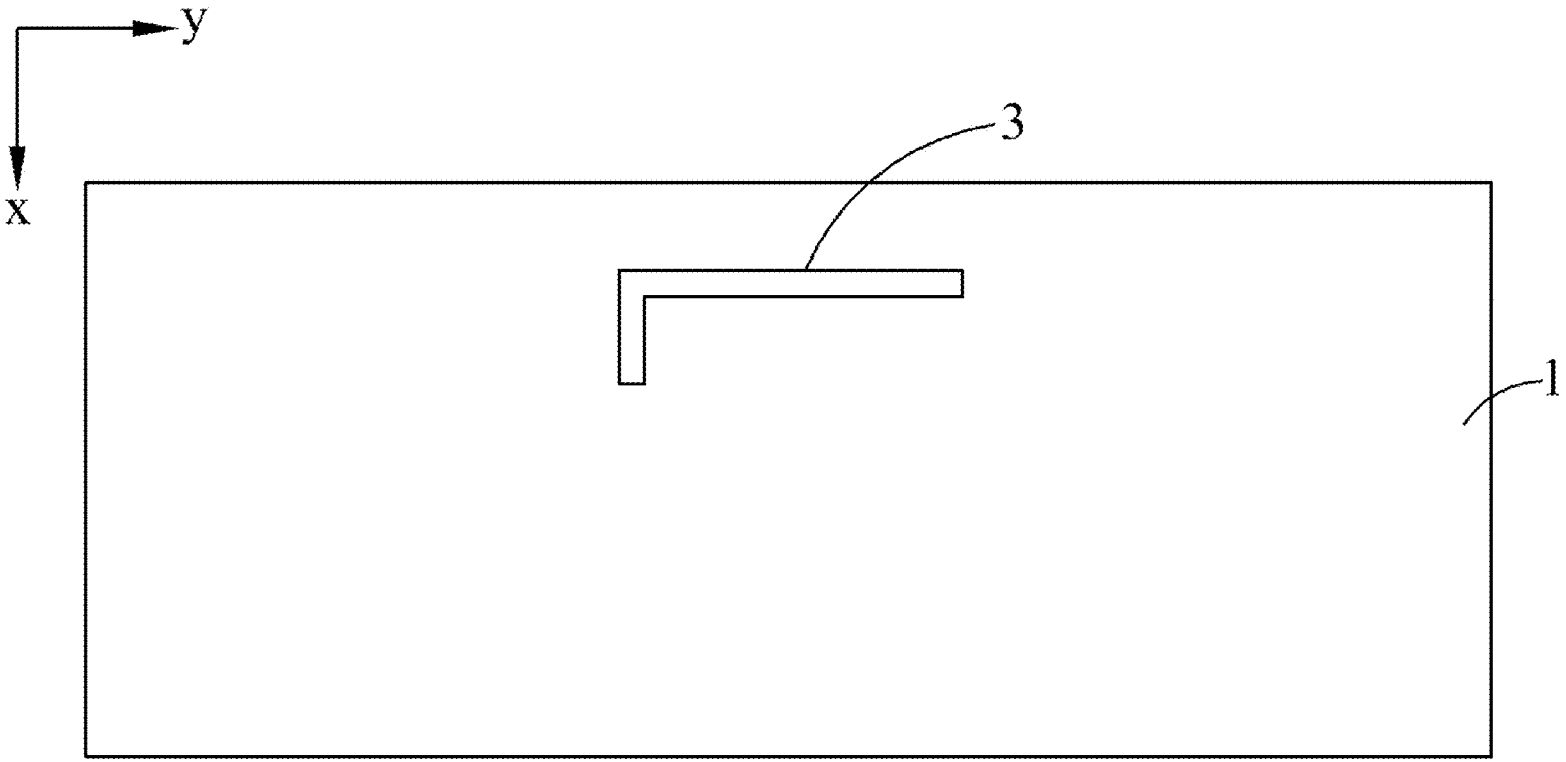
FIG. 5 is a top view of a planar antenna in accordance with a first preferred embodiment of the present invention.

With reference to FIGS. 3 to 5 for an exploded view, a bottom view and a top view of a planar antenna in accordance with a first preferred embodiment of the present invention respectively, the planar antenna comprises a substrate 1, a ground plane 2 and a feed line 3, wherein the ground plane 2 is disposed at the bottom side of the substrate and connected to the substrate. For convenience, the arrangement and the connection of the ground plane 2 with the substrate are drawn separately (as shown in FIG. 3) and the ground plane 2 has a hollow portion 4, and the feed line 3 may be an L-shaped micro-strip feed line disposed at the top side of the substrate 1 and corresponding to the hollow portion 4 for feeding a signal, and the hollow portion 4 is a slot, wherein the planar antenna includes a first resonance frequency and a second resonance frequency, and the first resonance frequency is determined by the length of the feed line 3, and the second resonance frequency is determined by the length of the hollow portion 4. The planar antenna is a dual band antenna, such that if the two resonance frequencies are substantially equal, a wideband antenna will be obtained.

Figure 6:
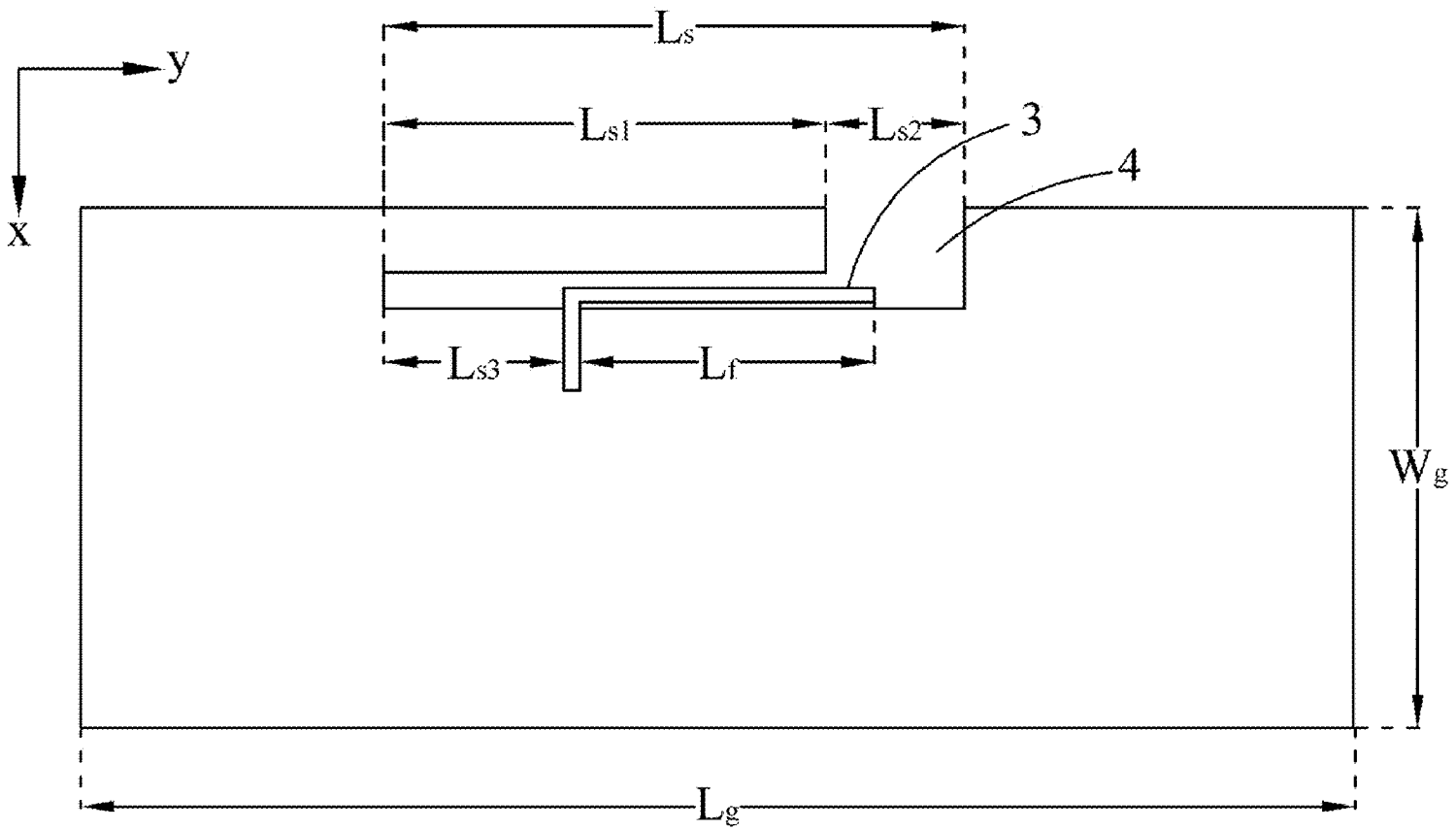
FIG. 6 is a schematic view of a planar antenna in accordance with a first preferred embodiment of the present invention.
Figure 7:
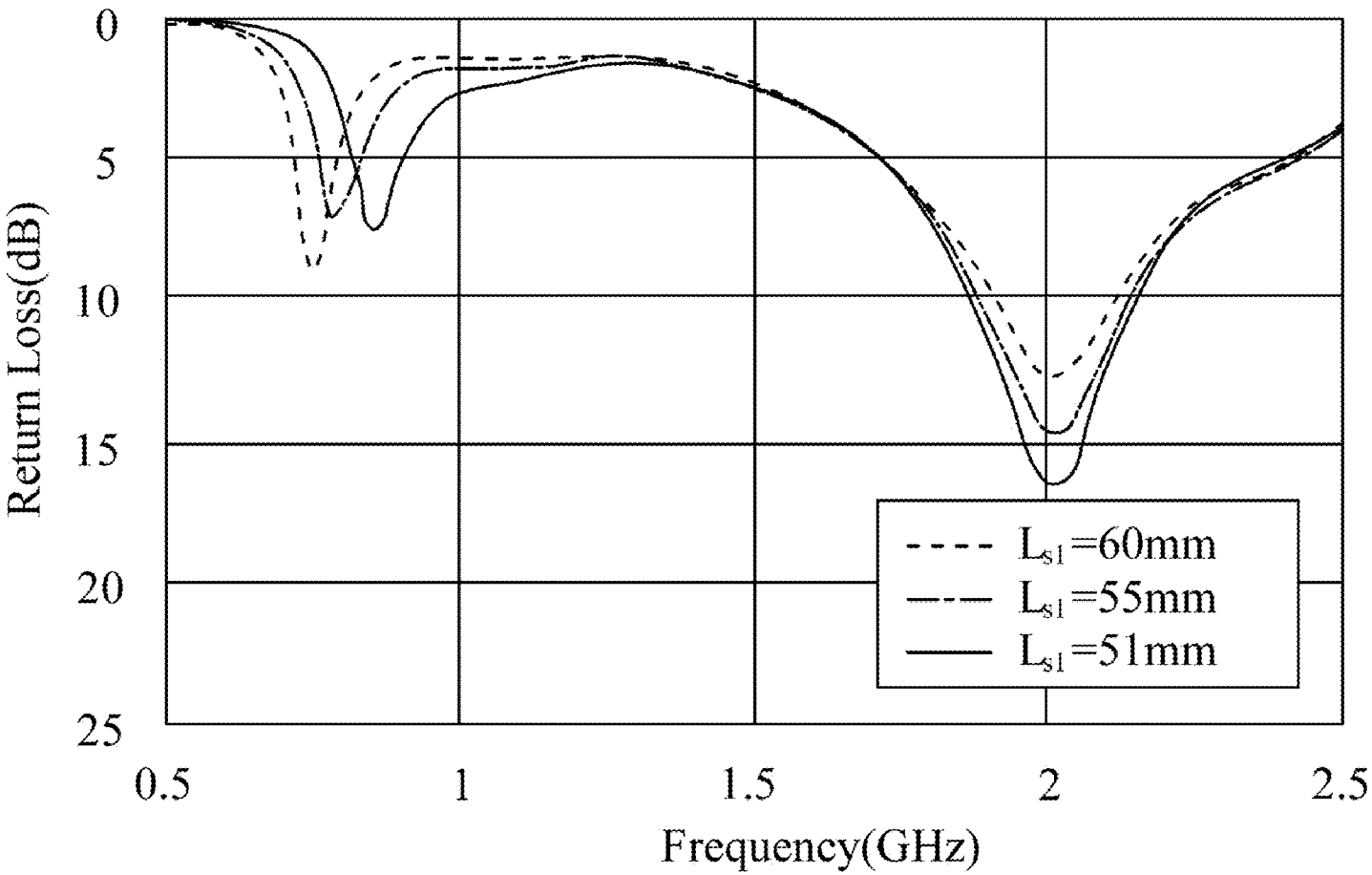
FIG. 7 is a graph of return loss versus frequency response of a planar antenna having a change of length of a slot in accordance with a first preferred embodiment of the present invention.
Figure 8:
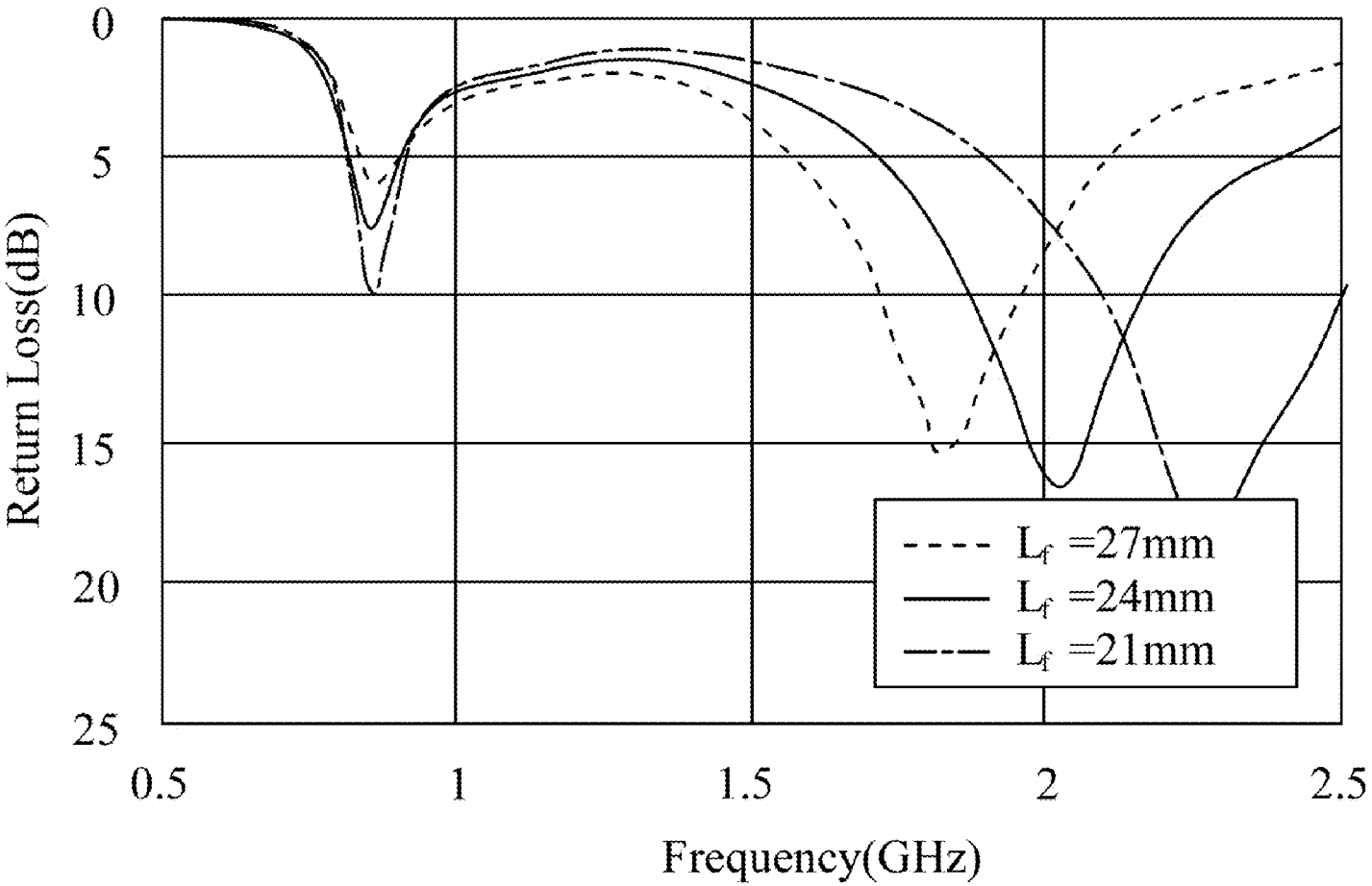
FIG. 8 is a graph of return loss versus frequency response of a planar antenna having a change of length of a feed line in accordance with a first preferred embodiment of the present invention.
Figure 9:
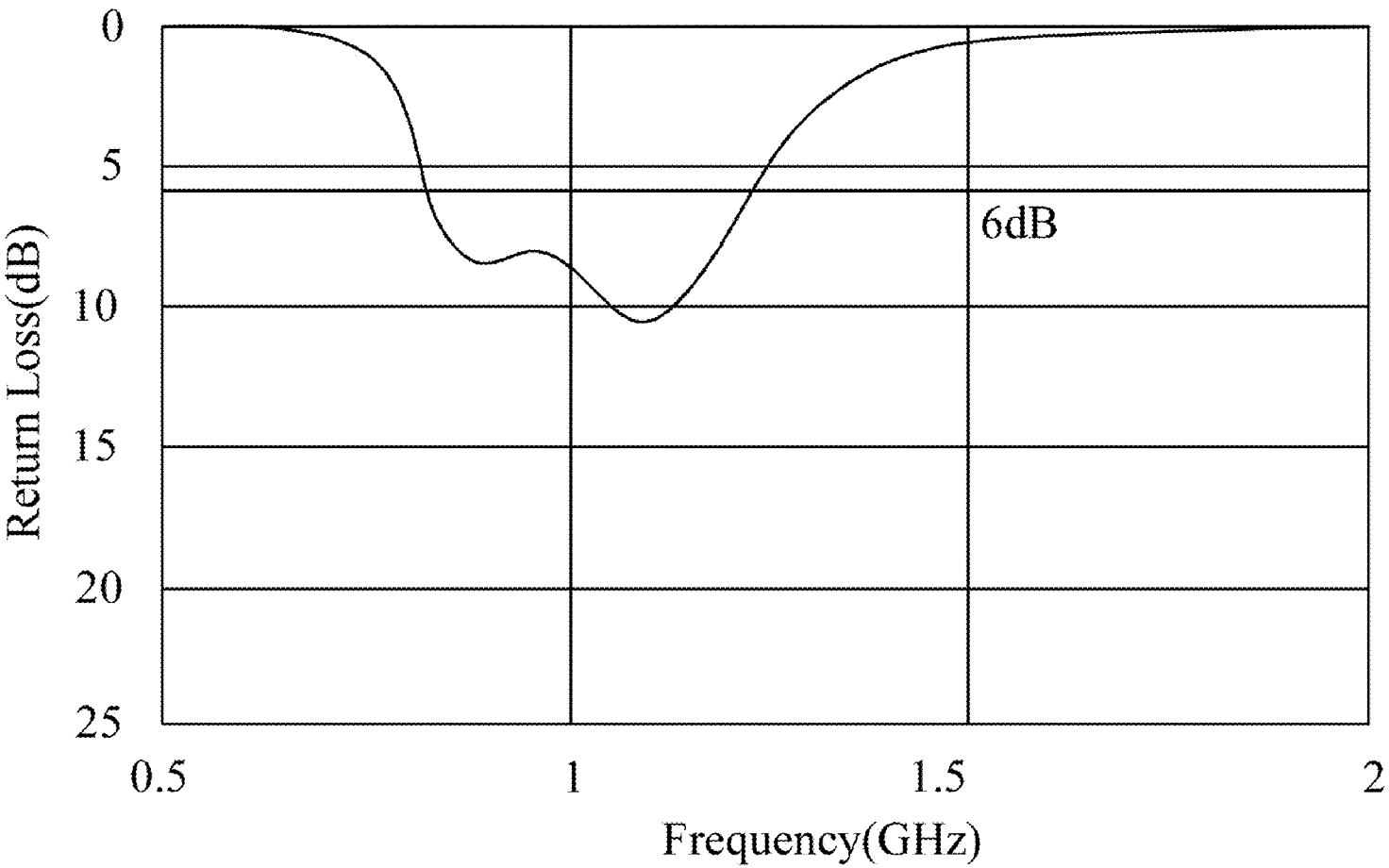
FIG. 9 is a schematic view of a single-band wideband planar antenna of the present invention.

With reference to FIGS. 6 and 7 for graphs of return loss versus frequency response of a planar antenna having a change of length of a slot in accordance with a first preferred embodiment of the present invention respectively, the lengths Ls (wherein $Ls=Ls_1+Ls_2$) and $L_f$ are constant. The longer the length $Ls_1$ (or the shorter the length $Ls_2$), the lower is the low-frequency center frequency, while the high-frequency center frequency remains unchanged. Thus, the length $Ls_1$ determines the low-frequency resonance frequency. With reference to FIG. 8 for a graph of return loss versus frequency response of a planar antenna having a change of length of a feed line in accordance with a first preferred embodiment of the present invention, the lengths Ls ($Ls=Ls_1+Ls_2$) and $Ls_1$ are constant, and $L_f+Ls_3=Ls_1$ is maintained. The longer the length $L_f$, the lower is the high-frequency center frequency, while the low-frequency center frequency remains unchanged. Thus, the length $L_f$ is the basis for determining the high-frequency resonance frequency. In FIGS. 7 and 8, the lengths of the slot and the feed line may be adjusted to change the first resonance frequency and the second resonance frequency, wherein the first resonance frequency is a high-frequency resonance frequency, and the second resonance frequency is a low-frequency resonance frequency, and if the two frequencies are substantially equal, a single-band wideband antenna will be obtained as shown in FIG. 9.

Figure 10:
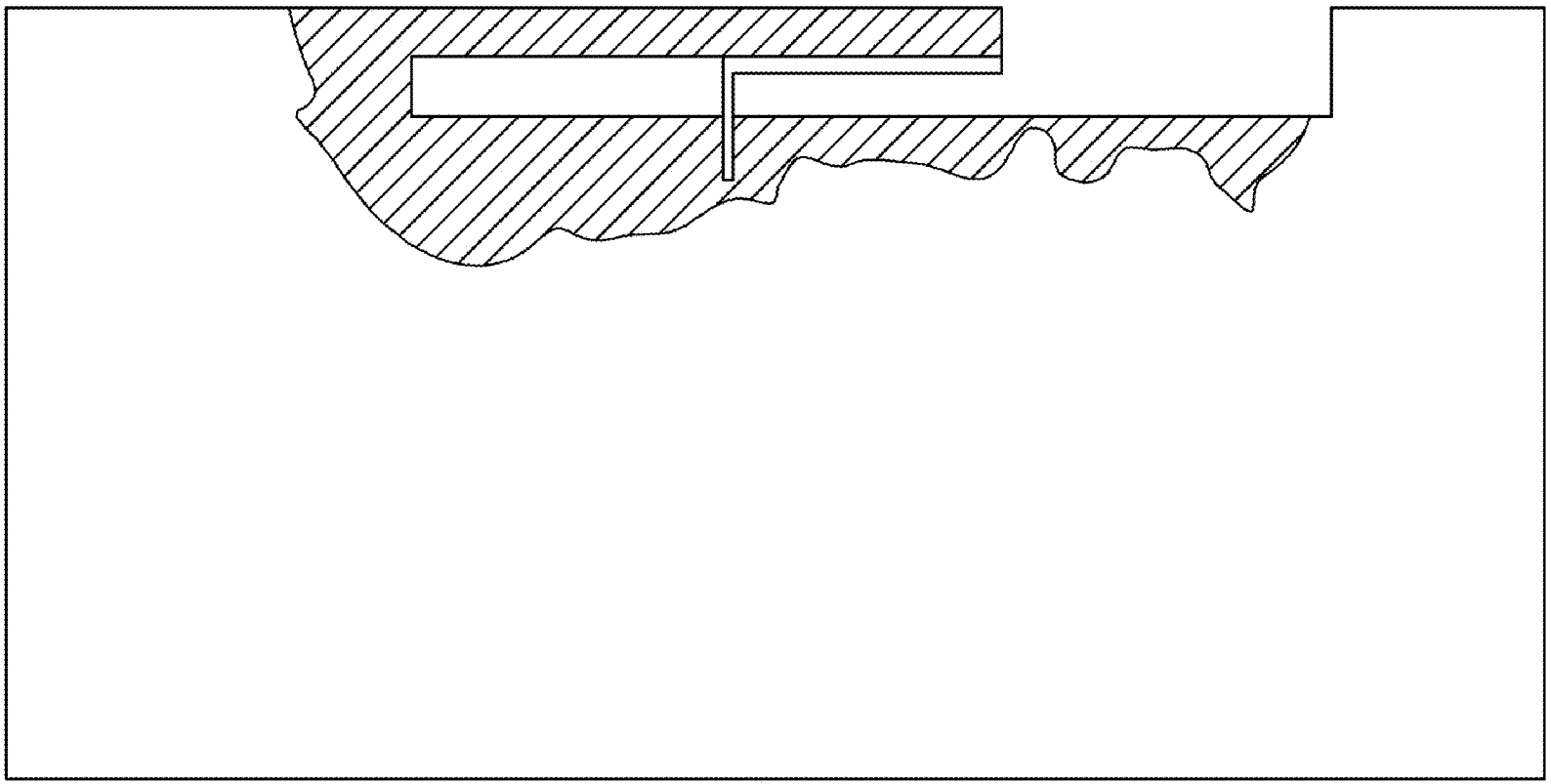
FIG. 10 is a simulated current distribution diagram of a planar antenna operated at a low frequency of 860 MHz in accordance with a first preferred embodiment of the present invention.
Figure 11:
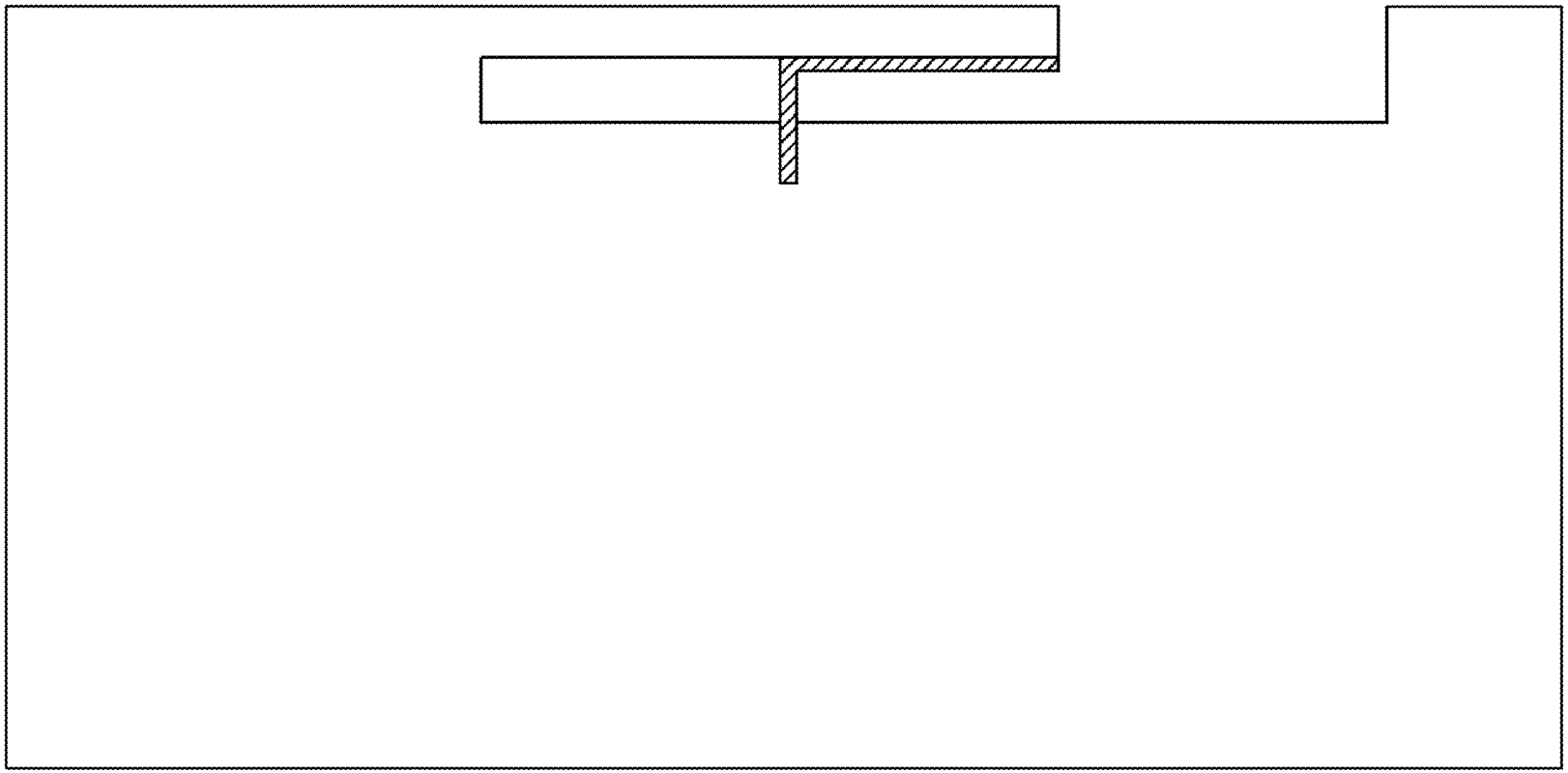
FIG. 11 is a simulated current distribution diagram of a planar antenna operated at a high frequency of 2000 MHz in accordance with a first preferred embodiment of the present invention.

With reference to FIG. 10 for a simulated current distribution diagram of a planar antenna operated at a low frequency of 860 MHz in accordance with a first preferred embodiment of the present invention, the current is concentrated at an edge of the slot, and the density of the current on the left side of the slot is the largest if the antenna is operated at 860 MHz, and the density of the current at an open circuit terminal is the smallest which is in a form of one-quarter of the wavelength of the resonance frequency. With reference to FIG. 11 for a simulated current distribution diagram of a planar antenna operated at a high frequency of 2000 MHz in accordance with a first preferred embodiment of the present invention, the current is concentrated at an L-shaped micro-strip feed line if the antenna is operated at 2000 MHz, which is also in the form of one-quarter of the wavelength of the resonance frequency, such that if the length of the feed line is changed, the first resonance frequency which is the high-frequency resonance frequency, may be changed. In other words, when the length of the slot is changed, the second resonance frequency, which is the low-frequency resonance frequency, is changed, too. The operating frequency of the planar antenna falls within a range from 824 MHz to 890 MHz, from 1850 MHz to 1900 MHz or from 1920 MHz to 2170 MHz. In addition, the ground plane has a size equal to the ground plane of a notebook computer, a thin notebook computer, a personal digital assistant (PDA) or a mobile phone.

Figure 12:
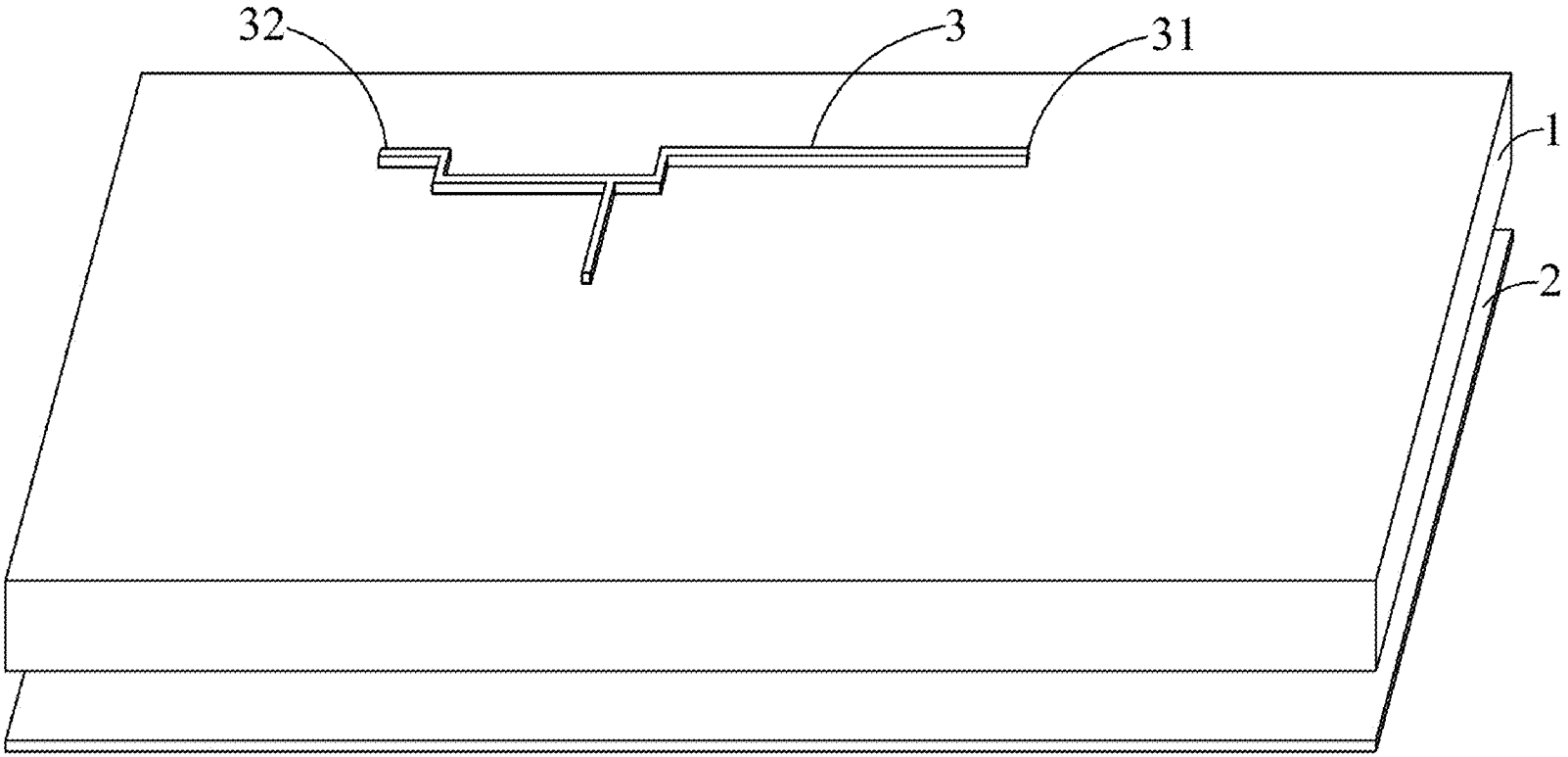
FIG. 12 is an exploded view of a planar antenna in accordance with a second preferred embodiment of the present invention.
Figure 13:
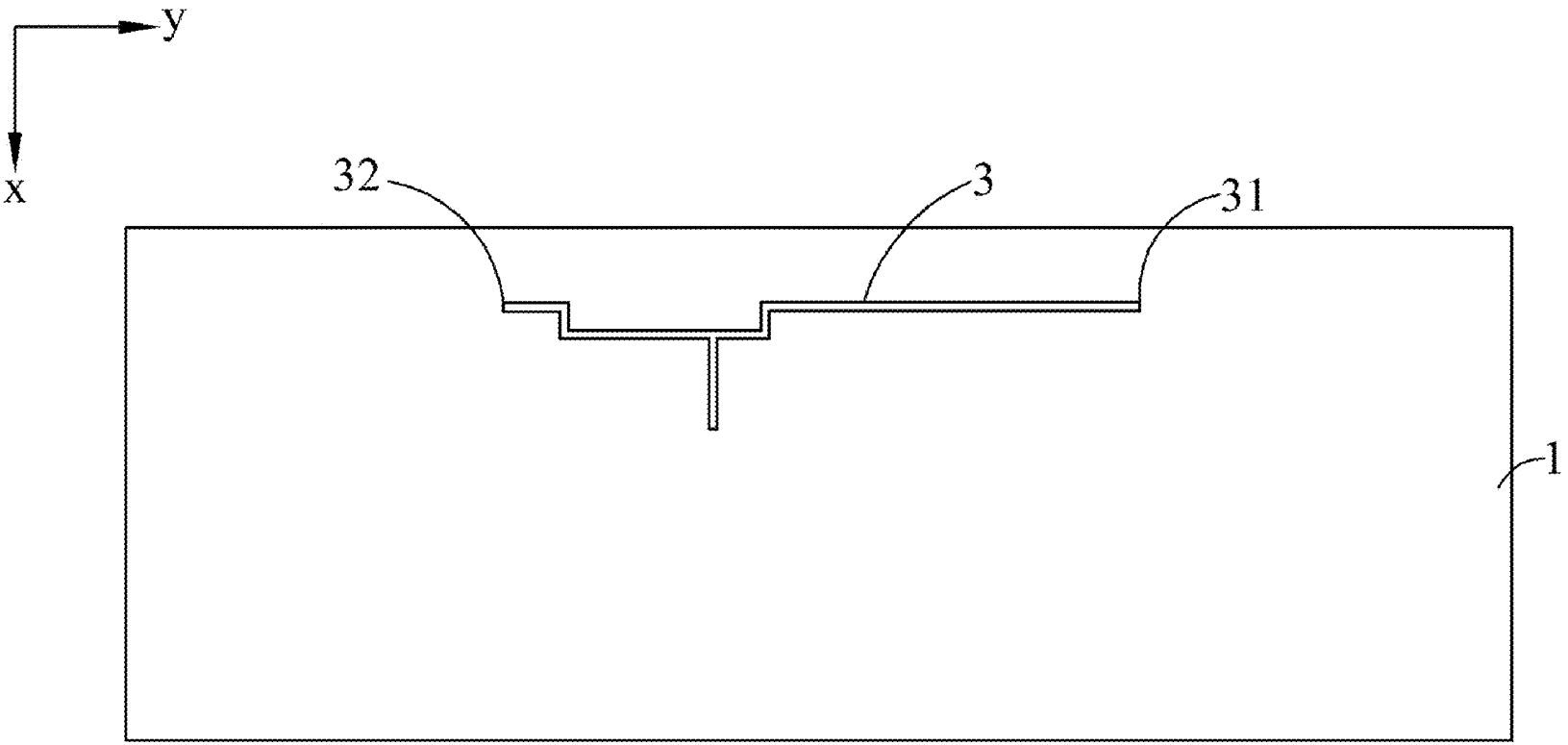
FIG. 13 is a top view of a planar antenna in accordance with a second preferred embodiment of the present invention.
Figure 14:
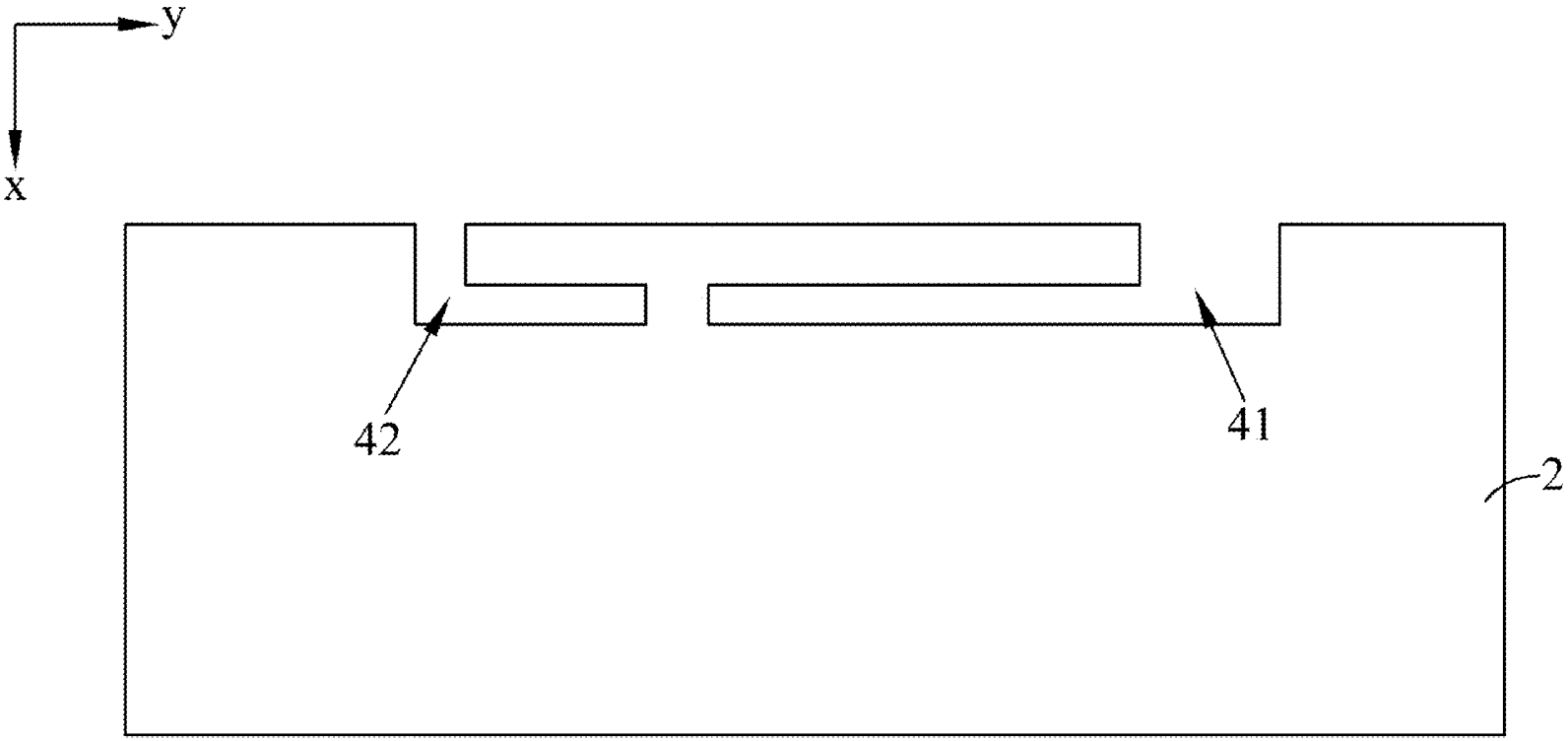
FIG. 14 is a bottom view of a planar antenna in accordance with a second preferred embodiment of the present invention.

With reference to FIGS. 12 to 14 for an exploded view, a top view and a bottom view of a planar antenna in accordance with a second preferred embodiment of the present invention respectively, the planar antenna comprises a substrate 1, a ground plane 2 and a feed line 3, wherein the ground plane 2 is disposed on the bottom surface of the substrate 1 and connected to the substrate. For convenience, the arrangement and connection are drawn separately (as shown in FIG. 12), and the planar antenna includes a first hollow portion 41 and a second hollow portion 42. The feed line 3 is disposed at an upper side of the substrate 1 and provided for feeding a signal, and the feed line 3 may be a T-shaped micro-strip feed line having a first branch feed portion 31 and a second branch feed portion 32, and the first branch feed portion 31 and the second branch feed portion 32 are aligned with the first hollow portion 41 and the second hollow portion 42 respectively, wherein the first hollow portion 41 is a first slot, and the second hollow portion 42 is a second slot, and the first slot is provided for an operation at a low-frequency band, and the second slot is provided for an operation at a high-frequency band.

The low-frequency band comprises a first resonance frequency and a second resonance frequency, and the first resonance frequency is determined by the length of the first branch feed portion 31, and the second resonance frequency is determined by the length of the first hollow portion 41, and the first hollow portion 41 has a length equal to one-quarter of a wavelength of the operating frequency, and the first branch feed portion 31 has a length equal to one-quarter of a wavelength of the operating frequency, and the high-frequency band comprises a third resonance frequency and a fourth resonance frequency, and the third resonance frequency is determined by the length of the second branch feed portion 32, and the fourth resonance frequency is determined by the length of the second hollow portion 42, and the second hollow portion 42 has a length equal to one-quarter of a wavelength of the operating frequency, and the second branch feed portion 32 has a length equal to one-quarter of a wavelength of the operating frequency.

Similarly, the length of the slot is changed, and the first slot is provided for an operation at a high-frequency band, and the second slot is provided for an operation at a low-frequency band. The low-frequency band may satisfy a GSM850 (from 824 MHz to 894 MHz) and a GSM900 (from 880 MHz to 960 MHz), and the high-frequency band may satisfy a GSM1800/

1900 (from 1850 MHz to 1990 MHz) and an UMTS2100 (from 1920 MHz to 2170 MHz), and thus the planar antenna is a five-band antenna.

Figure 15:
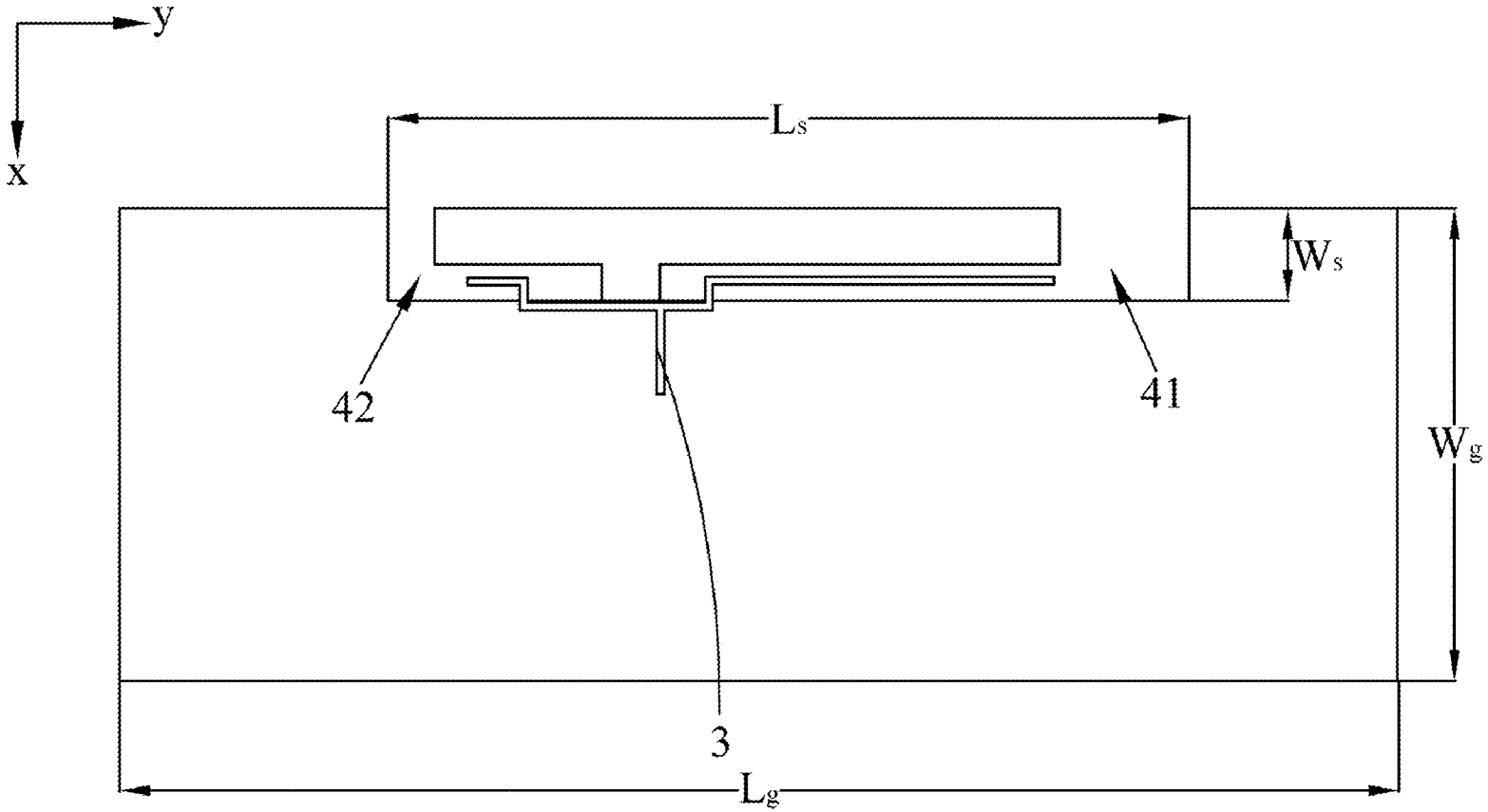
FIG. 15 is a schematic view of a planar antenna in accordance with a second preferred embodiment of the present invention.
Figure 16:
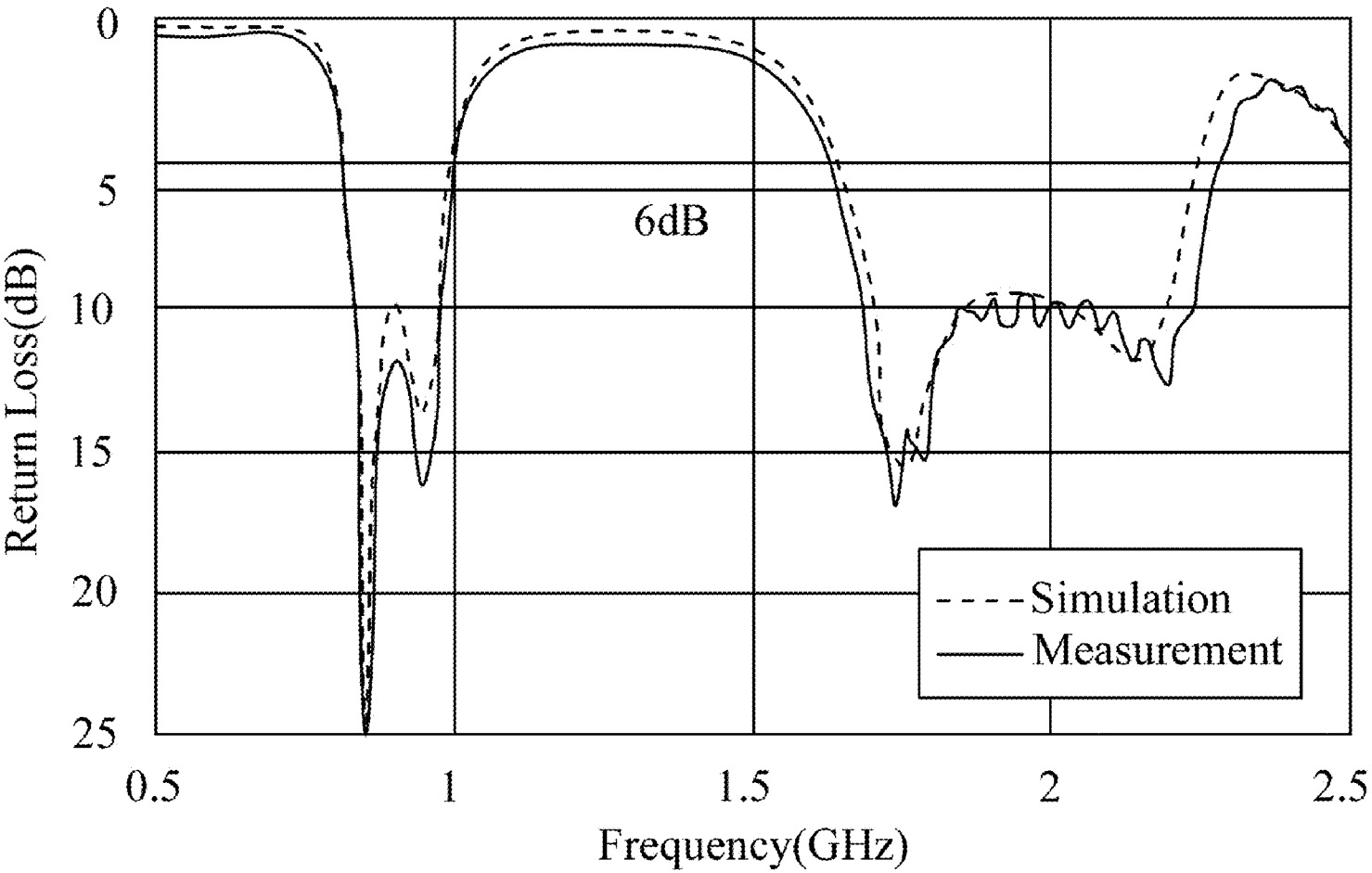
FIG. 16 is a graph of return loss versus frequency response of a planar antenna in accordance with a second preferred embodiment of the present invention.

With reference to FIGS. 15 and 16 for a planar antenna and a graph of return loss versus frequency response of the planar antenna in accordance with a second preferred embodiment of the present invention respectively, the planar antenna has a size equal to Ls×Ws=120 mm×9 mm, and the ground plane has a size equal to Lg×Wg=300 mm×200 mm, wherein the dotted line shows a simulated result, and the solid line shows a measured result, and the simulated and measured results are matched with each other, and the low-frequency band may satisfy the GSM850/900 (from 824 MHz to 894 MHz or from 880 MHz to 960 MHz), and the high-frequency band may satisfy the GSM1800/1900/UMTS2100 (from 1850 MHz to 1990 MHz or from 1920 MHz to 2170 MHz), which satisfies the five-band operation.

Figure 17:
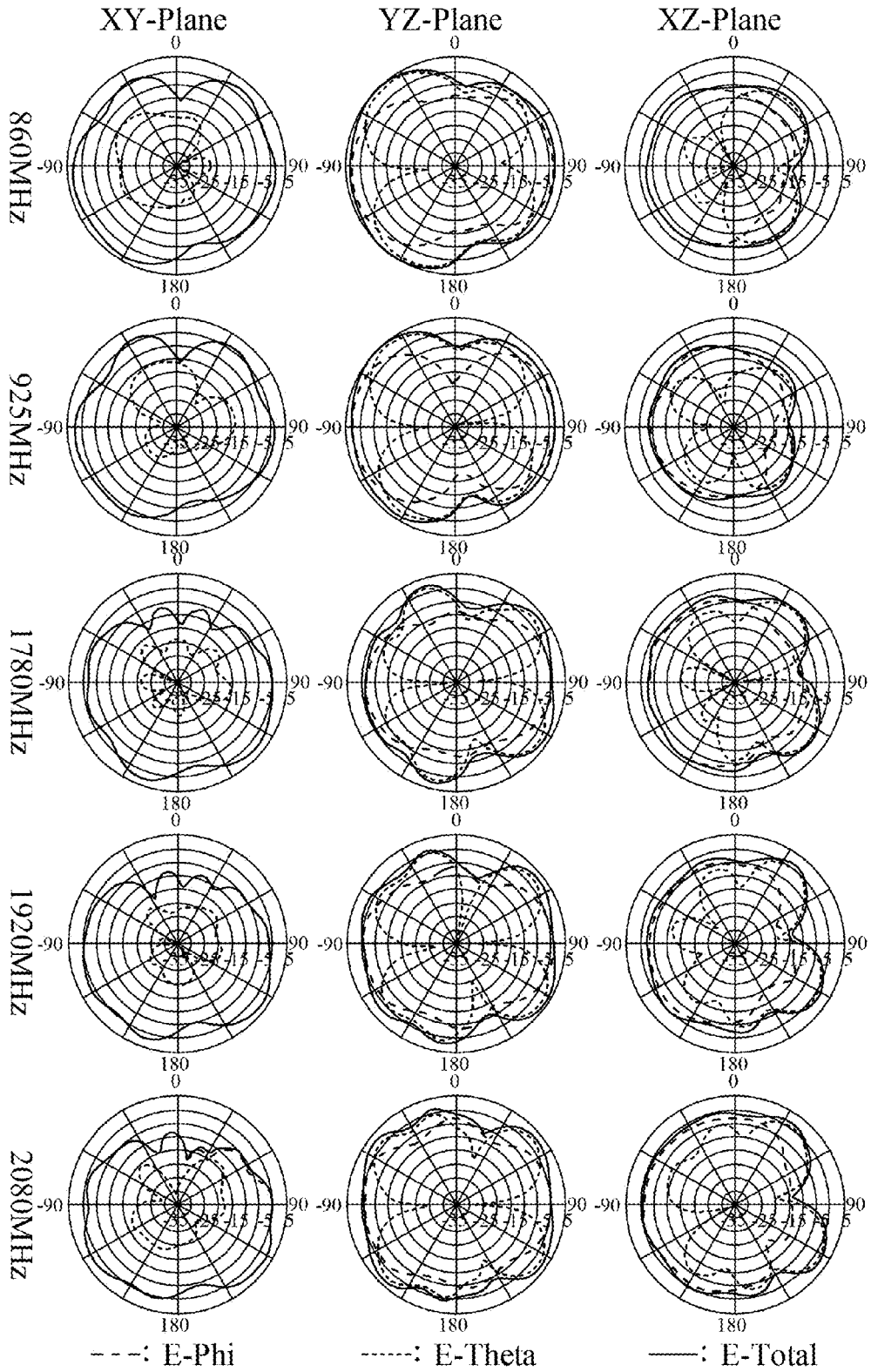
FIG. 17 is a radiation pattern diagram of a planar antenna in accordance with a second preferred embodiment of the present invention.

With reference to FIG. 17 for a radiation pattern diagram of a planar antenna in accordance with a second preferred embodiment of the present invention, five-band frequencies of the GSM850/900/1800/1900/UMTS2100 are processed to measure the radiation field of the antenna, wherein the dotted line represents E-phi and E-theta, and the solid line represents E-total. In summation of the radiation fields of antennas of different frequencies bands, the shapes of the radiation field of the antenna within the whole operating frequency are similar, indicating that the radiation is relatively stable. The comparison of average antenna gain and maximum antenna gain for each plane of each frequency is shown in Table 1, wherein the low frequency at the YZ-plane is approximately equal to 1.5 dBi, and the high frequency at the YZ-plane is approximately equal to 0 dBi, which show a very good radiation characteristic.

TABLE 1

Comparison of Average Antenna Gain and Maximum Antenna Gain for Three Major Planes of Each Frequency

| | Average Antenna Gain (dBi) | | | Maximum Antenna Gain (dBi) | | |
|---|---|---|---|---|---|---|
| Frequency (MHz) | XY-plane | YZ-plane | XZ-plane | XY-plane | YZ-plane | XZ-plane |
| 860 | 0.206449 | 2.06191 | −4.60627 | 3.138669 | 5.078565 | −3.0263 |
| 960 | −0.70114 | 1.545378 | −6.50529 | 2.242861 | 4.18726 | −3.63336 |
| 1780 | −2.28604 | −0.83148 | −3.23781 | 1.571881 | 2.075622 | −1.26622 |
| 1920 | −2.34919 | −0.40309 | −3.18061 | 1.815243 | 2.635541 | 0.103483 |
| 2080 | −2.13325 | 0.019458 | −1.72265 | 1.91159 | 2.750891 | 1.303491 |

Figure 18:
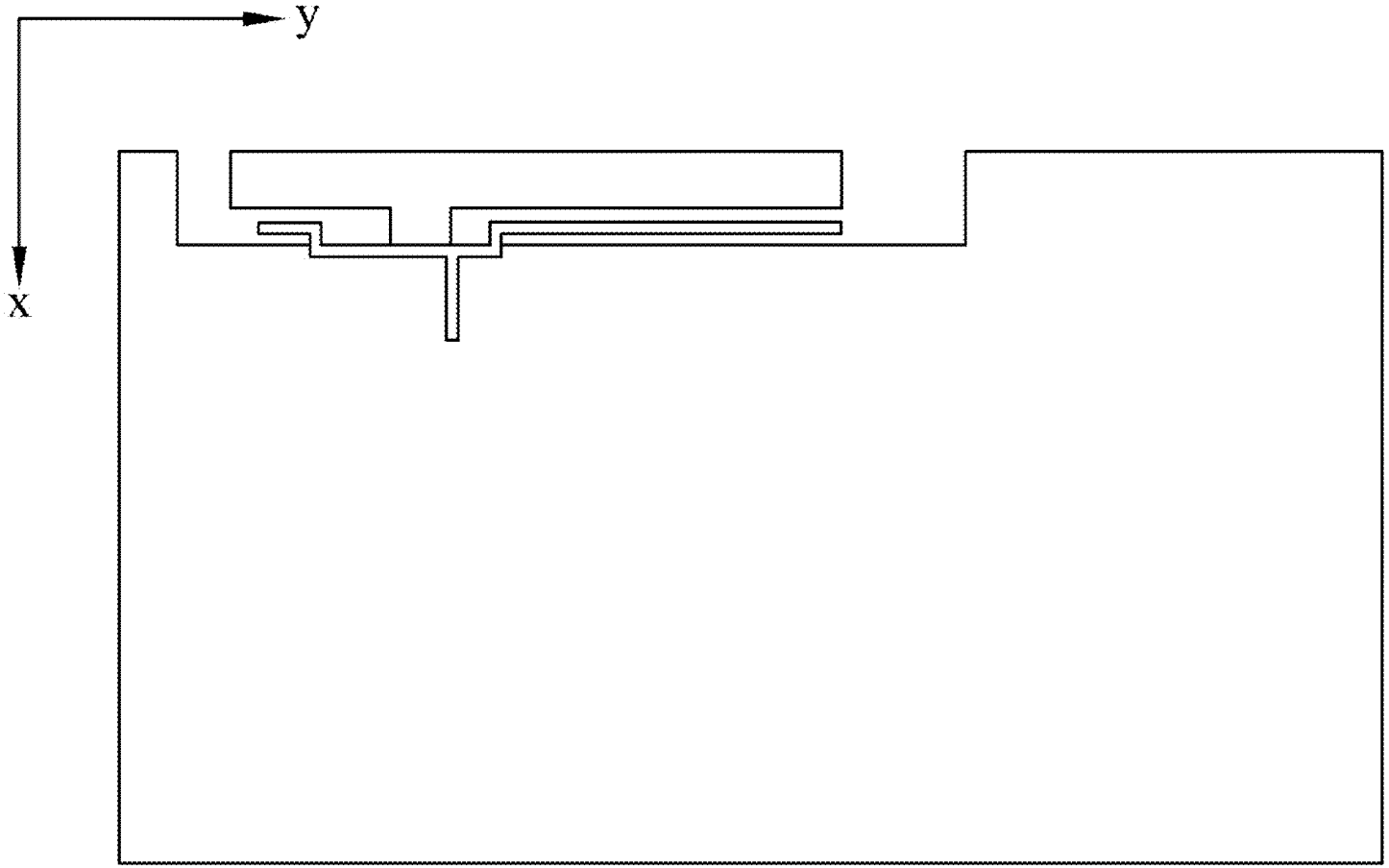
FIG. 18 is a schematic view of a planar antenna disposed at a left side of a top edge of a ground plane and having a change of a slot position in accordance with a third preferred embodiment of the present invention.
Figure 19:
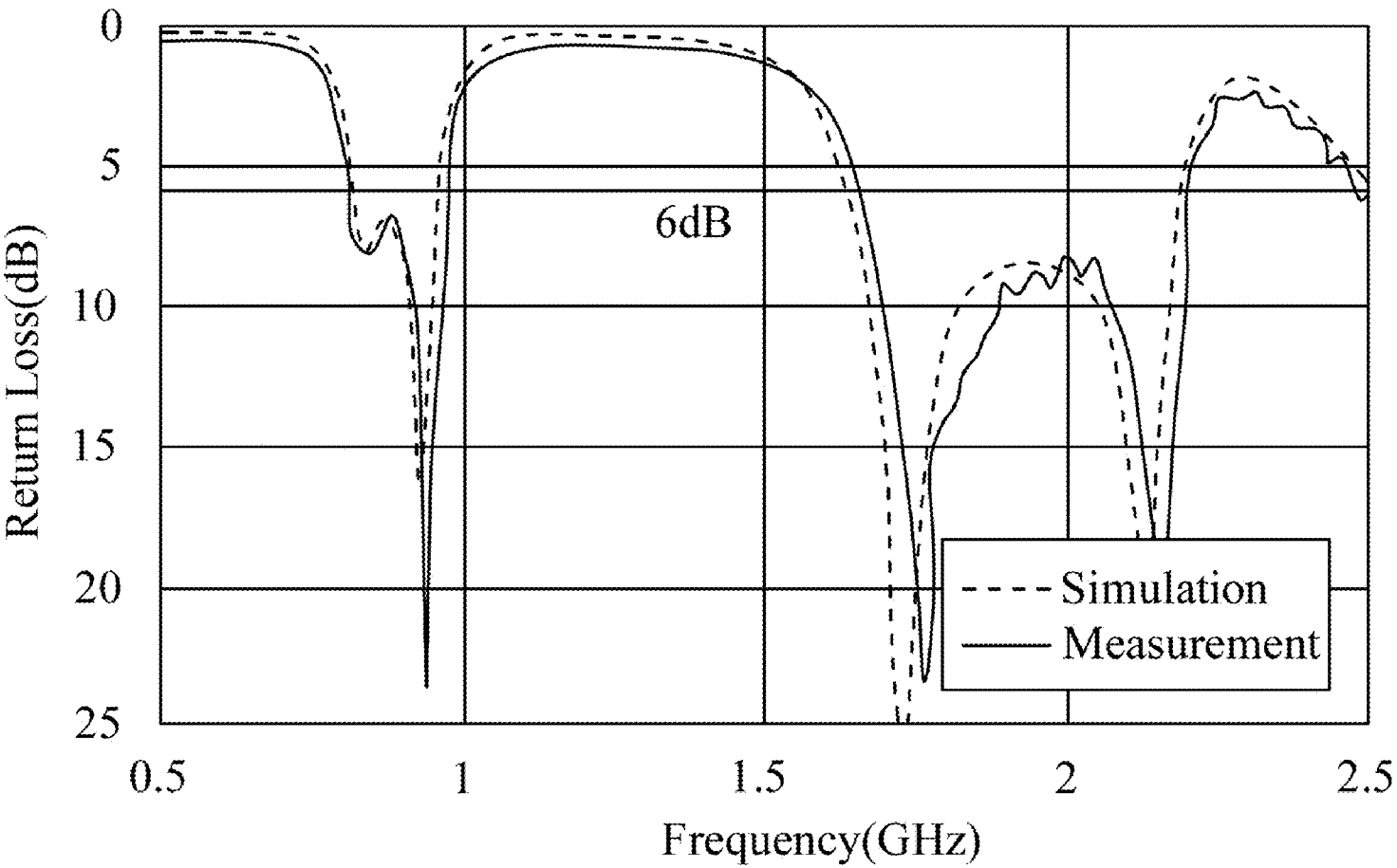
FIG. 19 is a graph of return loss versus frequency response of a measurement and a simulation of a planar antenna disposed at a left side of a top edge of a ground plane and having a change of a slot position in accordance with a third preferred embodiment of the present invention.

With reference to FIG. 18 for a schematic view of a planar antenna disposed at a left side of a top edge of a ground plane and having a change of a slot position in accordance with a third preferred embodiment of the present invention, the dotted line shows a simulated result and the solid line shows a measured result as shown in FIG. 19.

Figure 20:
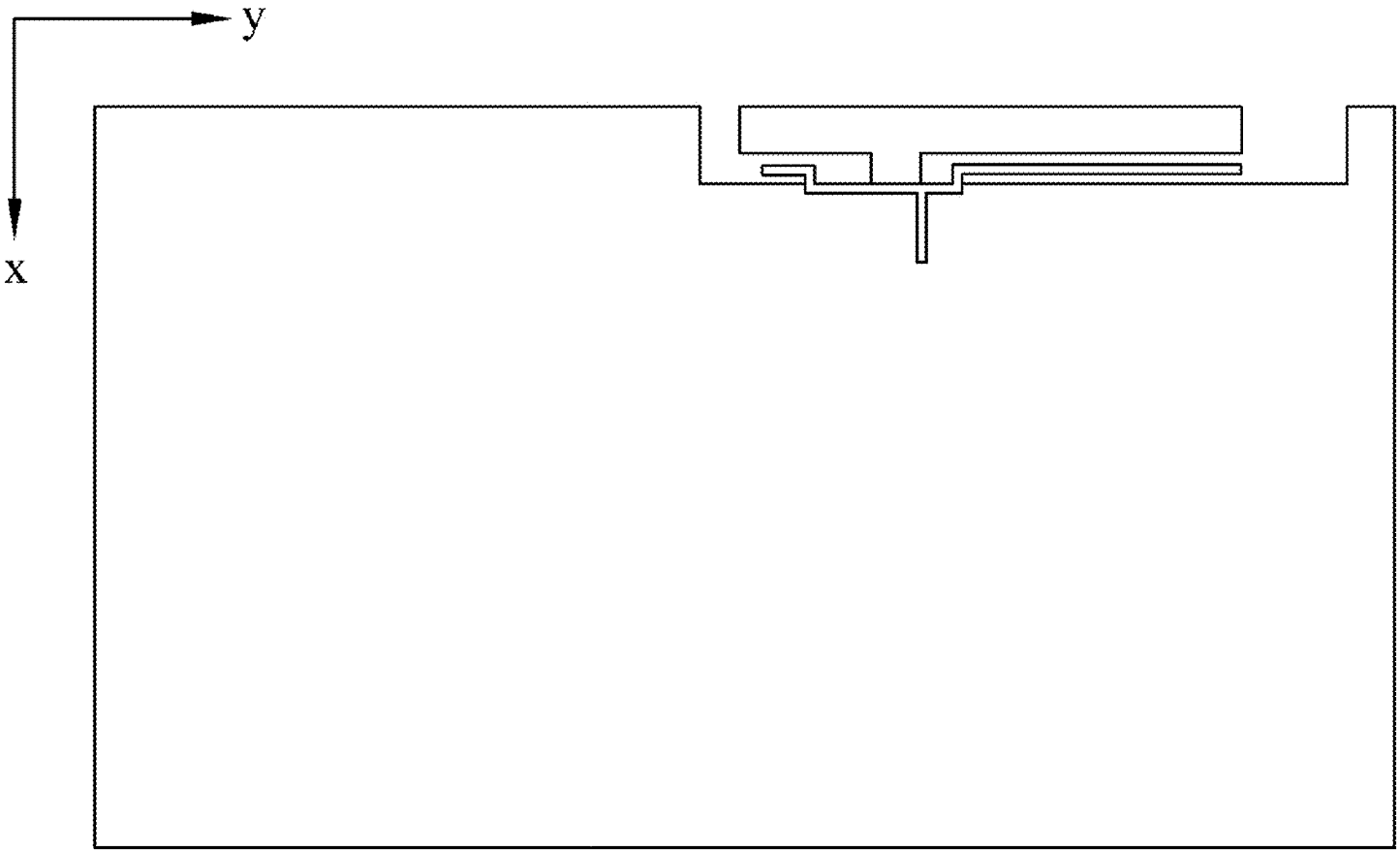
FIG. 20 is a schematic view of a planar antenna disposed at a right side of a top edge of a ground plane and having a change of a slot position in accordance with a fourth preferred embodiment of the present invention.
Figure 21:
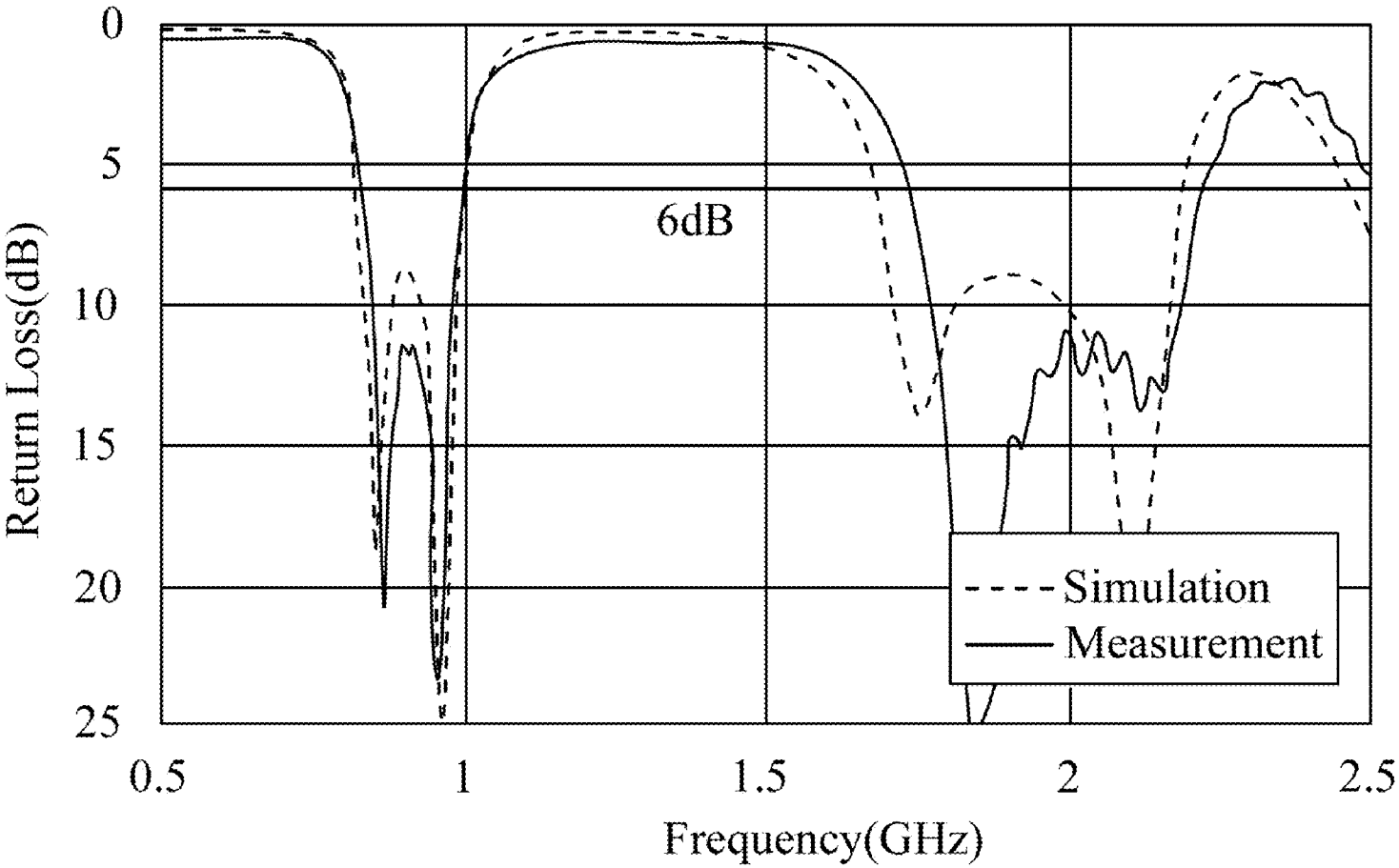
FIG. 21 is a graph of return loss versus frequency response of a measurement and a simulation of a planar antenna disposed at a right side of the top of a ground plate having a change of a slot position in accordance with a fourth preferred embodiment of the present invention.

With reference to FIG. 20 for a schematic view of a planar antenna disposed at a right side of a top edge of a ground plane and having a change of a slot position in accordance with a fourth preferred embodiment of the present invention, the dotted line shows a simulated result and the solid line shows a measured result as shown in FIG. 21.

In FIGS. 19 and 21, the planar antenna of the present invention may be disposed at a different position at an upper edge of the ground metal sheet, such that if the dimensions of the planar antenna are fine tuned appropriately, the requirement for the five-band antenna may be satisfied.

Figure 22:
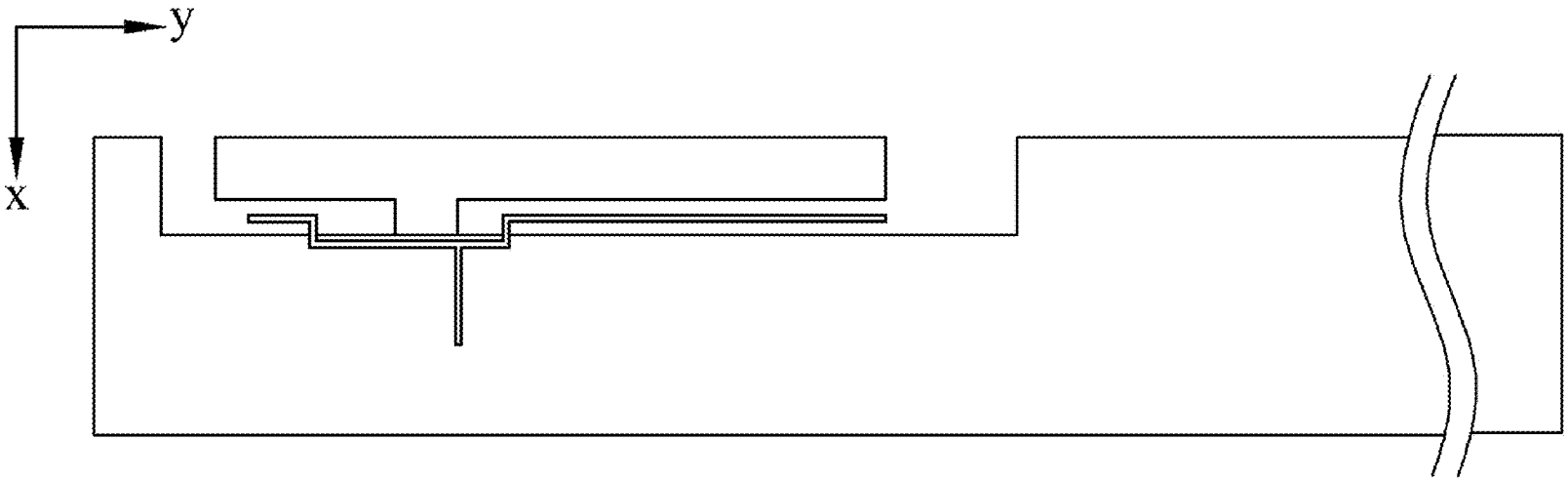
FIG. 22 is a schematic view of a planar antenna having a change of dimensions of a ground plane in accordance with a fifth preferred embodiment of the present invention.
Figure 23:
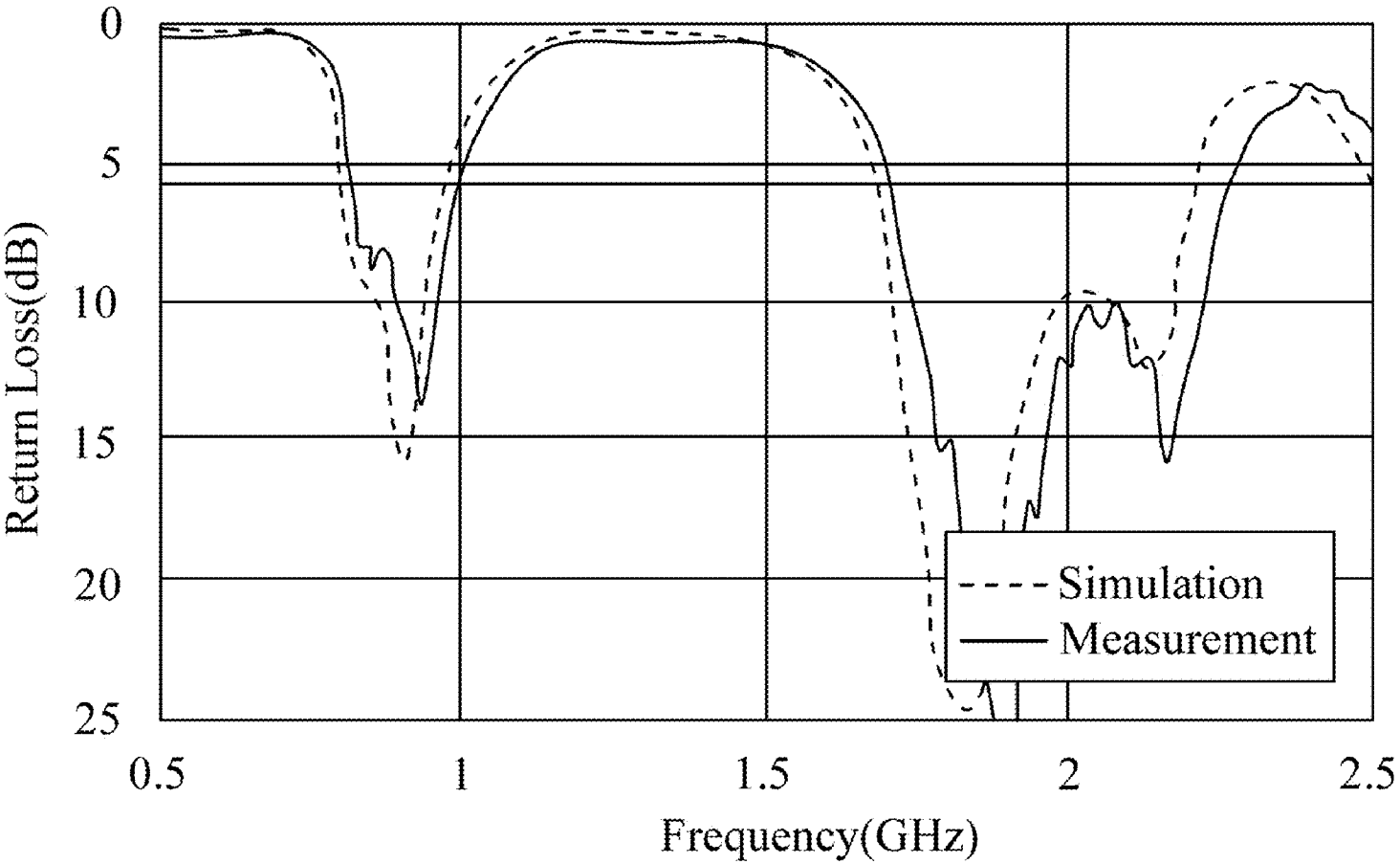
FIG. 23 is a graph of return loss versus of frequency response of a measurement and a simulation having a change of dimensions of a ground plane in accordance with a fifth preferred embodiment of the present invention.

With reference to FIG. 22 for a schematic view of a planar antenna having a change of dimensions of a ground plane in accordance with a fifth preferred embodiment of the present invention, the length of the ground plane is equal to 300 mm, but the width of the ground plane is reduced from the original 200 mm to 30 mm, and its return loss and frequency response are shown in FIG. 23. From the simulated and measured results, we know that the planar antenna of the present invention is applicable for a size (300 mm×200 mm) of a ground plane of a notebook computer. If the ground plane is reduced, the planar antenna is still applicable for the five-band operations, wherein the size of the ground plane is equal to the size of the ground plane of a notebook computer, a thin notebook computer, a personal digital assistant (PDA) or a mobile phone.

While the invention has been described by means of specific embodiments, numerous modifications and variations could be made thereto by those skilled in the art without departing from the scope and spirit of the invention set forth in the claims.

What is claimed is:

1. A planar antenna, comprising:

a substrate;

a ground plane, disposed on one side of the substrate, and having a hollow portion being a rectangular slot, with a longer side paralleled to one edge of the substrate, and with an opening disposed on one end of the longer side, the opening being communicating with the edge of the substrate; and a feed line, disposed on another side of the substrate and corresponding to the hollow portion, the feed line being substantially L-shaped with a longer portion and a shorter portion, the longer portion being horizontally overlapped with the hollow portion of the ground plane, such that substantially all of the longer portion being accommodated within the hollow portion, and the feed line being arranged for feeding a signal.

2. The planar antenna of claim 1, wherein the ground plane has a size equal to a ground plate of a notebook computer, a thin notebook computer, a personal digital assistant (PDA) or a mobile phone.

3. The planar antenna of claim 1, wherein the planar antenna includes a first resonance frequency and a second resonance frequency, and the first resonance frequency is determined by the length of the feed line, and the second resonance frequency is determined by the length of the hollow portion.

4. The planar antenna of claim 3, wherein the hollow portion has a length equal to one-quarter of the wavelength of an operating frequency.

5. The planar antenna of claim 3, wherein the feed line has a length equal to one-quarter of the wavelength of an operating frequency.

6. The planar antenna of claim 1, wherein the planar antenna has an operating frequency band falling within a range from 824 MHz to 890 MHz, 1850 MHz to 1900 MHz or 1920 MHz to 2170 MHz.

7. The planar antenna of claim 1, wherein the planar antenna is a wideband antenna or a dual band antenna.

8. The planar antenna of claim 1, wherein the hollow portion is disposed at a lateral edge of the ground plane.

9. A planar antenna, comprising:

a substrate;

a ground plane, disposed on one side of the substrate, and having a first hollow portion and a second hollow portion each being a rectangular slot, with a longer side paralleled to one edge of the substrate, and with an opening disposed on one end of the longer side, the opening being communicating with the edge of the substrate; and a feed line, disposed on another side of the substrate, the feed line being substantially T-shaped with a first branch feed portion and a second branch feed portion extending from two ends of the T-shaped feed line firstly toward the edge of the substrate and then parallel with the edge of the substrate, and the first branch feed portion and the second branch feed portion being horizontally overlapped with the first hollow portion and the second hollow portion respectively, such that the first branch feed portion and the second branch feed portion being accommodated with the first hollow portion and the second hollow portion respectively, and the feed line being arranged for feeding a signal.

10. The planar antenna of claim 9, wherein the ground plane has a size equal to a ground plate of a notebook computer, a thin notebook computer, a personal digital assistant (PDA) or a mobile phone.

11. The planar antenna of claim 9, wherein the first hollow portion is provided for operating a low-frequency band, and the second hollow portion is provided for operating a high-frequency band.

12. The planar antenna of claim 11, wherein the low-frequency band comprises a first resonance frequency and a second resonance frequency.

13. The planar antenna of claim 12, wherein the first resonance frequency is determined by the length of the first branch feed portion, and the second resonance frequency is determined by the length of the first hollow portion.

14. The planar antenna of claim 13, wherein the first hollow portion has a length equal to one-quarter of the wavelength of an operating frequency.

15. The planar antenna of claim 13, wherein the first branch feed portion has a length equal to one-quarter of the wavelength of an operating frequency.

16. The planar antenna of claim 11, wherein the high-frequency band comprises a third resonance frequency and a fourth resonance frequency.

17. The planar antenna of claim 16, wherein the third resonance frequency is determined by the length of the second branch feed portion, and the fourth resonance frequency is determined by the length of the second hollow portion.

18. The planar antenna of claim 17, wherein the second hollow portion has a length equal to one-quarter of the wavelength of an operating frequency.

19. The planar antenna of claim 17, wherein the second branch feed portion has a length equal to one-quarter of the wavelength of an operating frequency.

20. The planar antenna of claim 11, wherein the low-frequency band falls within a range from 824 MHz to 960 MHz, and the high-frequency band falls within a range from 1710 MHz to 2170 MHz.

21. The planar antenna of claim 9, wherein the planar antenna is a five-band antenna.

22. The planar antenna of claim 9, wherein the first hollow portion and the second hollow portion are disposed at a lateral edge of the ground plane.

* * * * *